US008637441B1

(12) United States Patent
Chen

(10) Patent No.: US 8,637,441 B1
(45) Date of Patent: Jan. 28, 2014

(54) NON-FOAMING DETERGENT AND PREPARATION METHOD THEREOF

(71) Applicant: Newer World International Company Limited, Kowloon (HK)

(72) Inventor: Shu Feng Chen, Kowloon (HK)

(73) Assignee: Newer World International Company Limited, Kowloon (HK)

( * ) Notice: Subject to any disclaimer, the term of this patent is extended or adjusted under 35 U.S.C. 154(b) by 0 days.

(21) Appl. No.: 13/692,605

(22) Filed: Dec. 3, 2012

(51) Int. Cl.

| | |
|---|---|
| ***C11D 7/12*** | (2006.01) |
| ***C11D 7/14*** | (2006.01) |
| ***C11D 7/18*** | (2006.01) |
| ***C11D 7/38*** | (2006.01) |
| ***C11D 7/54*** | (2006.01) |

(52) U.S. Cl.
USPC ..... 510/313; 510/130; 510/194; 510/238; 510/303; 510/372; 510/376; 510/477; 510/488; 510/499; 510/509; 510/511

(58) Field of Classification Search
USPC ..... 510/130, 194, 238, 303, 313, 372, 376, 510/477, 488, 499, 509, 511
See application file for complete search history.

(56) References Cited

U.S. PATENT DOCUMENTS

| | | | | |
|---|---|---|---|---|
| 2007/0244026 | A1* | 10/2007 | Barthel et al. | 510/445 |
| 2007/0270324 | A1* | 11/2007 | Bastigkeit et al. | 510/386 |
| 2008/0248989 | A1* | 10/2008 | Holderbaum et al. | 510/445 |

* cited by examiner

*Primary Examiner* — Gregory Delcotto
(74) *Attorney, Agent, or Firm* — Raymond R. Ferrera; Adams and Reese LLP

(57) ABSTRACT

The present invention discloses a non-foaming detergent, including a sodium alginate, an amylum, a sodium silicate, a citric acid, a sodium citrate, a sea salt, a sodium peroxyborate, a TAED and a borax. Herein, the non-foaming detergent further includes a sodium bicarbonate and a soapnut saponin. The preparation method of the non-foaming detergent comprises the following steps: mixing a sodium silicate and a sodium peroxyborate under stirring, mixing a soapnut saponin, a sodium alginate, an amylum, a sodium citrate, a sea salt, a sodium bicarbonate, a TAED and a borax under stirring, mixing such two mixtures, adding a citric acid therein and further mixing to obtain the non-foaming detergent. In the present invention, the prepared detergent has good solubility, strong activity at low temperature, high washing power and thorough detergency. Besides, the detergent is non-foaming and non-flavoring and the exhaust water during washing can be bio-degraded effectively.

2 Claims, No Drawings

NON-FOAMING DETERGENT AND PREPARATION METHOD THEREOF

FIELD OF THE INVENTION

The present invention relates to a non-foaming detergent, and specifically relates to a non-foaming detergent and a preparation method thereof.

BACKGROUND OF THE INVENTION

The present detergent is mainly composed of the following raw materials including a surface active agent, a builder, a fluorescent brightener, an enzyme, chlorine-containing disinfectant, a fragrance and the like. However, many countries have stopped producing the sodium alkyl benzene sulfonate in the surface active agent due to its difficult biodegradation. Sewage dissolved with such detergent is very harmful to aquatic organism and particularly to fishes when it is discharged into rivers. This is because the foam of the sewage may cover the water surface and thus reduce the dissolved oxygen in the water. For this reason, the taste bud tissue of fishes may also be damaged to become amblygeustia, while they lose the capability of foraging and avoiding toxicant. It has been estimated that fishes are difficult to live when the detergent concentration in the water is above 10 mg/L, and the growth of rice may be seriously affected or the rice may even die when the concentration is 45 mg/L. Besides, the dilute detergent can be partially absorbed by skin to cause allergy eczema. Some animal experiments show that the detergent has an effect of teratogenesis and further acts as one kind of synergistic carcinogenic substance. The significant application of trimeric sodium phosphate as a builder in the detergent is one important discover in the industry of synthetic detergent. However, the phosphate brings about serious eutrophication in the water and promotes the rapid propagation of algae therein when it is discharged into the rivers and lakes together with the washing sewage, as a result of which the oxygen in the water is insufficient and damage is caused to the living of aquatic animal. Accordingly, this has become a big problem in the environmental protection. Since 1970s, many euramerican developed countries have already proposed the problem of limiting the phosphorus in the detergent and further specified the content of phosphorus sequentially. In our country, the above-mentioned problems have not aroused sufficient attention in the past due to various reasons, in particular the price factor. The fluorescent brightener can bring about cell variability when it is absorbed by human body. Moreover, too much exposure to the fluorescent brightener may be potential to cause cancer. Enzymes can damage the protein on the surface of the skin and lead to rash, eczema and the like allergic phenomenon. Fragrance is harmful to human body since it can cause chronic poisoning and can even be teratogenic and carcinogenic.

SUMMARY OF THE INVENTION

The objective of this invention is to provide a non-foaming detergent which has changed from versatility into humanization and its preparation method. Herein, the non-foaming detergent is safe, non-toxic as well as free of pollution and side effect. It has an effect of disinfection, bacteriostasis, odor removal, decontamination, whitening and brightening. Besides, it can also prolong the life of The technical solution adopted to solve the technical problem of this invention is as follows: a non-foaming detergent, which comprises following raw materials by weight percentage: a sodium alginate of 1-10%, an amylum of 1-11%, a sodium silicate of 3-15%, a sodium peroxyborate of 8-21%, a sodium citrate of 13-25%, a citric acid of 15-30%, a sea salt of 10-25%, a borax of 1-17% and a tetraacetylethylenediamine (TAED) of 1-9%; wherein the non-foaming detergent also comprises a sodium bicarbonate of 13-25% and a soapnut saponin of 3-17%.

In the above-mentioned non-foaming detergent, the non-foaming detergent comprises the following raw materials by weight percentage: the sodium alginate of 3%, the amylum of 2%, the sodium silicate of 9%, the sodium peroxyborate of 15%, the sodium citrate of 15%, the citric acid of 17, the sea salt of 12%, the borax of 5% and the TAED of 2%; wherein the non-foaming detergent also comprises the sodium bicarbonate of 15% and the soapnut saponin of 5%.

According to another aspect of this invention, a method for preparing the above-mentioned non-foaming detergent is provided, which comprises the following steps:

a, adding a pre-weighted sodium silicate and sodium peroxyborate into a mixing tank after filtering through a filter screen, and mixing them under stirring for 10-15 minutes;

b, adding a soapnut saponin, a sodium alginate, an amylum, a sodium citrate, a sea salt, a sodium bicarbonate, a TAED and a borax into a mixing tank after filtering through a filter screen and mixing them under stirring for 5-10 minutes therein;

c, adding a mixture obtained in step a into a mixture obtained in step b, mixing the two mixtures under stirring for 5-10 minutes, adding a citric acid into the mixtures and further mixing them under stirring for 5-10 minutes to obtain the non-foaming detergent.

In the above-mentioned method for preparing the non-foaming detergent, the method comprises the following steps:

a, adding the pre-weighted sodium silicate and sodium peroxyborate into the mixing tank after filtering through the filter screen, and mixing them under stirring for 10 minutes;

b, adding the soapnut saponin, the sodium alginate, the amylum, the sodium citrate, the sea salt, the sodium bicarbonate, the TAED and the borax into the mixing tank after filtering through the filter screen and mixing them under stirring for 5 minutes therein;

c, adding the mixture obtained in step a into the mixture obtained in step b, mixing the two mixtures under stirring for 5 minutes, adding the citric acid into the mixtures and further mixing them under stirring for 5 minutes to obtain the non-foaming detergent.

The design principle of this invention is as follows:

Herein, some organic raw materials including the citric acid, the soapnut saponin, the starch, the sodium citrate and the sodium alginate, the natural raw material (i.e. the sea salt) as well as the strong oxidizer (i.e. sodium peroxyborate) are adopted. The citric acid as a builder can improve the performance of the detergent product, and it is an excellent chelating agent and disinfectant. In detail, it can quickly precipitate the metal ions, prevent the pollutant from attaching onto the fabric, keep the necessary alkaline washing, disperse and suspend the dirt and the dust, and improve the performance of the surface active agent. The soapnut saponin is a peel extract from the wild *Sapindus mukorossi* Gareth. It is one kind of natural and non-ionic surface active agent without the addition of any synthetic detergent, fragrance, pigment and antiseptic; that is, it is a pure natural product. The soapnut saponin has a strong effect of reducing the surface tension. When it is used for cleaning the skin (bath, face washing, hand washing and hair washing) and washing the clothes, it exhibits good cleaning performance, removes the dirt effectively, has no peculiar smell, and acts as antibiosis, beautifying, whitening, freckle removing, acne removing as well as prevention and treatment of skin disease. Besides, the soapnut saponin is mild and non-stimulating with 100% degradation, which does not produce any residues that are harmful to both human health and environment. The sodium peroxyborate can be used as the additive and builder of the detergent. It can effectively play a role in the bleaching, disinfection and sterilization. Besides, it causes no corrosion to the fabric and household articles, thus being widely applied to the washing and bleaching of cotton fabric, chemical fiber, rayon, short fiber, linen fabric and wool fabric to prevent them from yellowing. Moreover, the sodium peroxyborate has no influence on the fabric; instead, it is capable of enhancing the flexibility, the abrasion resistance and the effective antistatic effect of the fabric. The TAED is an activating agent belonging to the strong oxidant. It can improve the cleaning effect as well as the functions of disinfection and sterilization of the strong oxidant in the low-temperature water.

The application range of the non-foaming detergent in this invention includes the cleaning of various cotton fabrics, chemical fibers, rayon, short fibers, linen fabrics and wool fabrics. Likewise, it can also be used in metal detergent, cabinet cleaner, food appliance cleaner, vegetable and fruit cleaner, denture cleaner, oral cleaner, ceramic cleaner, antibacterial cleaner, milk bottle cleaner, hand washing agent, pet cleaner, shampoo, body wash and the like.

A dosage standard of the non-foaming detergent in this invention is as follows: 7-10 grams are used for clothes per kilogram; if it is used in metal detergent, cabinet cleaner, food appliance cleaner, vegetable and fruit cleaner, denture cleaner, oral cleaner, ceramic cleaner, antibacterial cleaner, milk bottle cleaner, hand washing agent, pet cleaner, shampoo and body wash, it is diluted in the water by a ratio of 1:1000.

The advantageous effect of this invention is as follows:

such raw materials in utilization in this invention are in compatibility with each other, while the detergent prepared therefrom has good solubility, strong activity at low temperature, high washing power and thorough detergency. Besides, the detergent is non-foaming and non-flavoring and the exhaust water during washing can be bio-degraded effectively. Moreover, the detergent which is low-carbon green can cause no harm to the fabric and the human skin, suppress *Staphylococcus, Escherichia coli* and *Candida* aibicans effectively, have an effect of removing odor, achieve a water and power saving and meet the scope of energy conservation and emission reduction.

DETAILED DESCRIPTION OF THE PREFERRED EMBODIMENT

Embodiment 1

A non-foaming detergent in embodiment 1 is composed of the following components by weight percentage:

sodium alginate 3%,
amylum 2%,
sodium silicate 9%,
sodium peroxyborate 15%,
sodium citrate 15%,
citric acid 17%,
sea salt 12%,
borax 5%,
TAED 2%,
sodium bicarbonate 15%, and
soapnut saponin 5%.

The preparation of the non-foaming detergent in embodiment 1 comprises the following steps:

Step a, the pre-weighted sodium silicate and sodium peroxyborate are added into a mixing tank after filtering through a filter screen, and they are mixed under stirring for 10 minutes; step b, the soapnut saponin, the sodium alginate, the amylum, the sodium citrate, the sea salt, the sodium bicarbonate, the TAED and the borax are added into a mixing tank after filtering through a filter screen and they are mixed under stirring for 5 minutes therein; step c, a mixture obtained in step a is added into a mixture obtained in step b, the two mixtures are mixed under stirring for 5 minutes, then the citric acid is added into the mixtures and they are further mixed under stirring for 10 minutes; and step d, a sampling inspection is carried out and then the mixture obtained in step c is packed when the sampling inspection is qualified to obtain the non-foaming detergent.

Embodiment 2

A non-foaming detergent in embodiment 2 is composed of the following components by weight percentage:

sodium alginate 1%,
amylum 1%,
sodium silicate 3%,
sodium peroxyborate 8%,
sodium citrate 13%,
citric acid 15%,
sea salt 10%,
borax 1%,
TAED 9%,
sodium bicarbonate 25%, and
soapnut saponin 14%.

The preparation of the non-foaming detergent in embodiment 2 comprises the following steps:

Step a, the pre-weighted sodium silicate and sodium peroxyborate are added into a mixing tank after filtering through a filter screen, and they are mixed under stirring for 15 minutes; step b, the soapnut saponin, the sodium alginate, the amylum, the sodium citrate, the sea salt, the sodium bicarbonate, the TAED and the borax are added into a mixing tank after filtering through a filter screen and they are mixed under stirring for 7 minutes therein; step c, a mixture obtained in step a is added into a mixture obtained in step b, the two mixtures are mixed under stirring for 7 minutes, then the citric acid is added into the mixtures and they are further mixed under stirring for 5 minutes; and step d, a sampling inspection is carried out and then the mixture obtained in step c is packed when the sampling inspection is qualified to obtain the non-foaming detergent.

Embodiment 3

A non-foaming detergent in embodiment 3 is composed of the following components by weight percentage:

sodium alginate 1%,
amylum 1%,
sodium silicate 15%,
sodium peroxyborate 21%,
sodium citrate 13%,
citric acid 16%,
sea salt 11%,
borax 5%,
TAED 1%,
sodium bicarbonate 13%, and
soapnut saponin 3%.

The preparation of the non-foaming detergent in embodiment 3 comprises the following steps:

Step a, the pre-weighted sodium silicate and sodium peroxyborate are added into a mixing tank after filtering through a filter screen, and they are mixed under stirring for 12 minutes; step b, the soapnut saponin, the sodium alginate, the amylum, the sodium citrate, the sea salt, the sodium bicarbonate, the TAED and the borax are added into a mixing tank after filtering through a filter screen and they are mixed under stirring for 10 minutes therein; step c, a mixture obtained in step a is added into a mixture obtained in step b, the two mixtures are mixed under stirring for 7 minutes, then the citric acid is added into the mixtures and they are further mixed under stirring for 7 minutes; and step d, a sampling inspection is carried out and then the mixture obtained in step c is packed when the sampling inspection is qualified to obtain the non-foaming detergent.

Embodiment 4

A non-foaming detergent in embodiment 4 is composed of the following components by weight percentage:

sodium alginate 10%,
amylum 1%,
sodium silicate 3%,
sodium peroxyborate 8%,
sodium citrate 13%,
citric acid 15%,
sea salt 10%,
borax 1%,
TAED 1%,
sodium bicarbonate 21%, and
soapnut saponin 17%. (Its preparation method is the same as that in embodiment 1)

Embodiment 5

A non-foaming detergent in embodiment 5 is composed of the following components by weight percentage:

sodium alginate 1%,
amylum 1%,
sodium silicate 3%,
sodium peroxyborate 8%,
sodium citrate 25%,
citric acid 15%,
sea salt 13%,
borax 17%,
TAED 1%,
sodium bicarbonate 13%, and
soapnut saponin 3%. (Its preparation method is the same as that in embodiment 1)

Embodiment 6

A non-foaming detergent in embodiment 6 is composed of the following components by weight percentage:

sodium alginate 2%,
amylum 11%,
sodium silicate 3%,
sodium peroxyborate 8%,
sodium citrate 13%,
citric acid 15%,
sea salt 25%,
borax 6%,
TAED 1%,
sodium bicarbonate 13%, and
soapnut saponin 3%. (Its preparation method is the same as that in embodiment 1)

Embodiment 7

A non-foaming detergent in embodiment 7 is composed of the following components by weight percentage:

sodium alginate 1%,
amylum 1%,
sodium silicate 14%,
sodium peroxyborate 8%,
sodium citrate 13%,
citric acid 30%,
sea salt 10%,
borax 6%,
TAED 1%,
sodium bicarbonate 13%, and
soapnut saponin 3%. (Its preparation method is the same as that in embodiment 1)

The content above is some further explanations in detail for this invention with respect to specific implementation. It should not be deemed that the specific implementation is limited to these explanations. For those ordinary skills in the art this invention belongs to, several equivalent replacement or obvious variant can be made out without departing from the idea of this invention. As long as they have the same performance or usage, they should be considered to be within the protection scope of this intention defined by the appended claims.

The invention claimed is:

1. A non-foaming detergent, which comprises following raw materials by weight percentage:

sodium alginate 1-10%,
amylum 1-11%,
sodium silicate 3-15%,
sodium peroxyborate 8-21%,
sodium citrate 13-25%,
citric acid 15-30%,
sea salt 10-25%,
borax 1-17%,
tetraacetylethylenediamine 1-9%;
sodium bicarbonate 13-25%, and
soapnut saponin of 3-17%.

2. The non-foaming detergent of claim 1, which comprises the following raw materials by weight percentage:

sodium alginate 3%,
amylum 2%,
sodium silicate 9%,
sodium peroxyborate 15%,
sodium citrate 15%,
citric acid 17%,
sea salt 12%,
borax 5%,
tetraacetylethylenediamine 2%;
sodium bicarbonate 15%, and
soapnut saponin of 5%.

* * * * *